United States Patent [19]

Lenorák

[11] 4,165,599

[45] Aug. 28, 1979

[54] ARRANGEMENT FOR TWISTING OF FIBROUS MATERIAL

[75] Inventor: Ferdinand Lenorák, Bratislava, Czechoslovakia

[73] Assignee: Slovenska vedecko-technicka spolocnost, Dom techniky, Bratislava, Czechoslovakia

[21] Appl. No.: 880,605

[22] Filed: Feb. 23, 1978

[30] Foreign Application Priority Data

Feb. 25, 1977 [CS] Czechoslovakia ..... 1260/77
Apr. 7, 1977 [CS] Czechoslovakia ..... 2302/77

[51] Int. Cl.[2] ..... D01H 7/86; D01H 7/88

[52] U.S. Cl. ..... 57/58.83; 57/58.61; 57/58.63

[58] Field of Search ..... 57/58.49, 58.52, 58.61, 57/58.63, 58.65, 58.67, 58.68, 58.7, 58.72, 58.78, 58.83, 58.86

[56] References Cited

U.S. PATENT DOCUMENTS

| | | | |
|---|---|---|---|
| 1,690,373 | 11/1928 | Marchev | 57/58.61 X |
| 2,526,147 | 10/1950 | MacCreadie | 57/58.61 X |
| 3,147,581 | 9/1964 | Godderidge | 57/58.63 |
| 3,475,892 | 11/1969 | Taira et al. | 57/58.61 |
| 3,956,875 | 5/1976 | Lenorak | 57/58.83 X |

FOREIGN PATENT DOCUMENTS

| | | | |
|---|---|---|---|
| 1074938 | 10/1954 | France | 57/58.83 |

*Primary Examiner*—Donald Watkins
*Attorney, Agent, or Firm*—Burgess, Ryan and Wayne

[57] ABSTRACT

Filaments or yarn are twisted by means of an arrangement provided with three at least partly hollow shafts rotating at equal or different rotating speeds and in the same or different sense, while the fibrous material is guided so as to pass alternately through the hollow shafts when taken off from a supply package and to carriers fixed to these shafts, to be thereby twisted and taken off by a take-up device.

6 Claims, 2 Drawing Figures

ARRANGEMENT FOR TWISTING OF FIBROUS MATERIAL

SUMMARY OF THE INVENTION

The invention relates to an arrangement for processing of fibrous material by twisting.

In a prior art yarn twisting process, a yarn supply package is rotated, or, with ring spinning one-for-one spindles and flyers, yarn or strand is wound onto the spindle when twisted.

When using two-for-one spindles, the yarn supply package is stationary while yarn or strand is withdrawn therefrom.

A disadvantage of such spindle types resides in that the centrifugal force generated by the rotation of the supply package or by the package formation in the spindle, does not allow the formation of so called giant packages. By means of a two-for-one spindle, it is impossible to process a giant supply package of fine titre filament. All these aforementioned spindle types are disadvantageous in that they are relatively ineffective in manufacturing twisted yarn, because they impart only a low small twist only to the yarn or strands during a single spindle revolution.

SUMMARY OF THE INVENTION

It is an object of this invention to provide an arrangement for twisting of fibrous material which operates efficiently and requires only a limited space, while generating the necessary number of twists per unit length. The arrangement according to this invention has at least three partly hollow shafts situated one behind the other and preferably coaxial, each of said shafts supporting a carrier of the processed fibrous material, said shafts rotating at equal or different speeds and in the same sense of rotation or with one shaft rotating in an opposite direction, whereby between the middle shaft and one of the outer shafts a supply package of filament or yarn is provided, with guiding elements for the processed fibrous material guiding it from the supply package through the hollow of the middle shaft to the carrier fixed on this middle subsequently into the hollow of one of the outer shafts and to the carrier fixed on this shaft, to the carrier fixed on the other outer shaft and through the hollow of this other outer shaft to a take-up device. In the course of passage of the filament or yarn through this track a number of twists are generated depending on the relative speeds of the shafts. Generally two twists are generated by the rotation of the middle shaft, with one twist generated by rotation of each of the remaining shafts.

DESCRIPTION OF DRAWINGS

Two examplary embodiments are shown diagrammatically in the attached drawings both in longitudinal sectional views, wherein.

DESCRIPTION OF PREFERRED EMBODIMENTS

Figure 1:
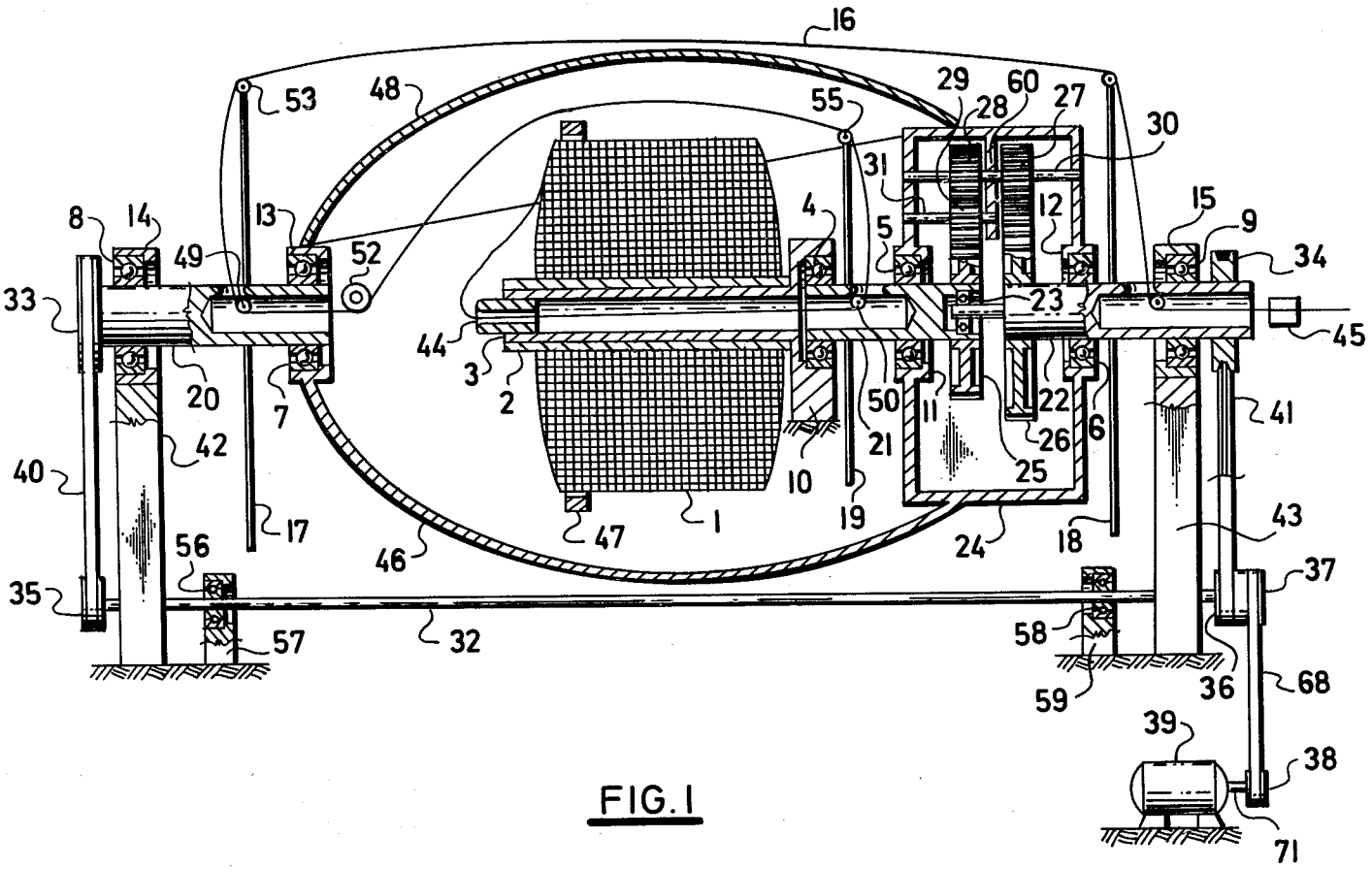
FIG. 1 shows an arrangement where the middle shaft rotates in a sense opposite to that of both outer shafts.

With reference to FIG. 1 a frame is provided, from which the left side wall 42 and the right side wall 43 are shown. A bearing 8 and a bushing 14 in the left side wall

42 are supporting a left outer shaft 20, a similar bearing 9 and bushing 15 in the right side wall 43 are supporting a right outer shaft 22. A pulley 33 is fixed on the left shaft 20 and another pulley 34 is fixed on the right shaft 22. Both these outer shafts 20 and 22 receive a rotating motion from an electric motor 39, on the shaft 71 of which a pulley 38 is fixed, driving over a belt 68 another pulley 37 fixed on a shaft 32 supported by the frame by bearings 56,58 and bushings 57,59.

Further pulleys 35 and 36 are fixed on the shaft 32 transmitting over belts 40 and 41 the rotating motion to pulleys 33 and 34 respectively. A stable trough 46 is furthermore fixed to the frame, supporting on the left end a bushing 13 and a bearing 7 for the left over shaft 20, on the right end a transmission gear case 24, which in turn supports a bushing 12 and a bearing 6 for the right outer shaft 22 and a bushing 11 and a bearing 5 for the middle shaft 21. The trough is covered by a removable cover 48. An additional bushing 10 and bearing 4 for the middle shaft 21 are supported by a not shown part of the frame or trough 46. A toothed wheel 26 is fixed on shaft 22 meshing with another toothed wheel 27 on a shaft 30 supported rotatably by the walls of the gear case 24, on which shaft 30 another toothed wheel 28 is fixed, engaging with a pinion 29 on an intermediate shaft 31 supported by one side wall of the gear case 24 and by an auxiliary partition wall 60 in the gear case 24. The pinion 29 meshes with a toothed wheel 25 on the middle shaft 21, so that to this middle shaft 21 a rotating motion is imparted in a sense opposite to that of both outer shafts 20 and 22.

An extension of shaft 22 engages a recess of shaft 21 where a bearing 23 for this extension is provided. Each of the shafts 20,21 and 22 supports a carrier 17,19 and 18 respectively, each with a guiding roll 53,55 and 54 respectively on said carrier 17, 19 and 18 for guiding the filament or yarn 16. Similar guiding rolls 49,50,51 are situated at places, where the hollow parts of shafts 20,21,22 are communicating with the ambient space.

A removable hollow support 3 for a supply package 1 of fibrous material is situated within the trough 46, resting with one end on the stable bushing 10 of the bearing 4 of the middle shaft 21, with the other end on not shown supporting means in the trough. The supply package 1 is wound on a tube 2, which is slipped on on the support 3. A filament brake 44 is on the external end of the support 3 opposite to the middle shaft 21 and a take-up device 45 for the filament near the end of shaft 22.

The described arrangement operates as follows: After starting the electric motor 39, all three shafts 20,21,22 start to rotate, whereby the middle shaft 21 rotates in an opposite sense to the rotation of shafts 20 and 22.

The fibrous material 16 is wound off from the supply package 1 and enters via the filament brake 44 the hollow support 3 of the package and the hollow of the middle shaft 21, passes over roll 50 and a roll 55 on the carrier 19 on the middle shaft 21 to a galette 52 in front of the left outer shaft 20, through its hollow, over roll 49 in this hollow to roll 53 on the carrier 17 on shaft 20, to roll 54 on the carrier 18 of shaft 22, to roll 51 within this shaft 22 and to the take-up device 45. In the course of this passage the filament or yarn is twisted several times, depending on the rotating speeds of shafts 20,21,22. Generally two twists are imparted by the middle shaft 21, one twist by each shaft 20 and 22 per revolution of these shafts.

Instead of belt drives, it is of course possible to use toothed wheels or any other suitable kind of drives.

Figure 2:
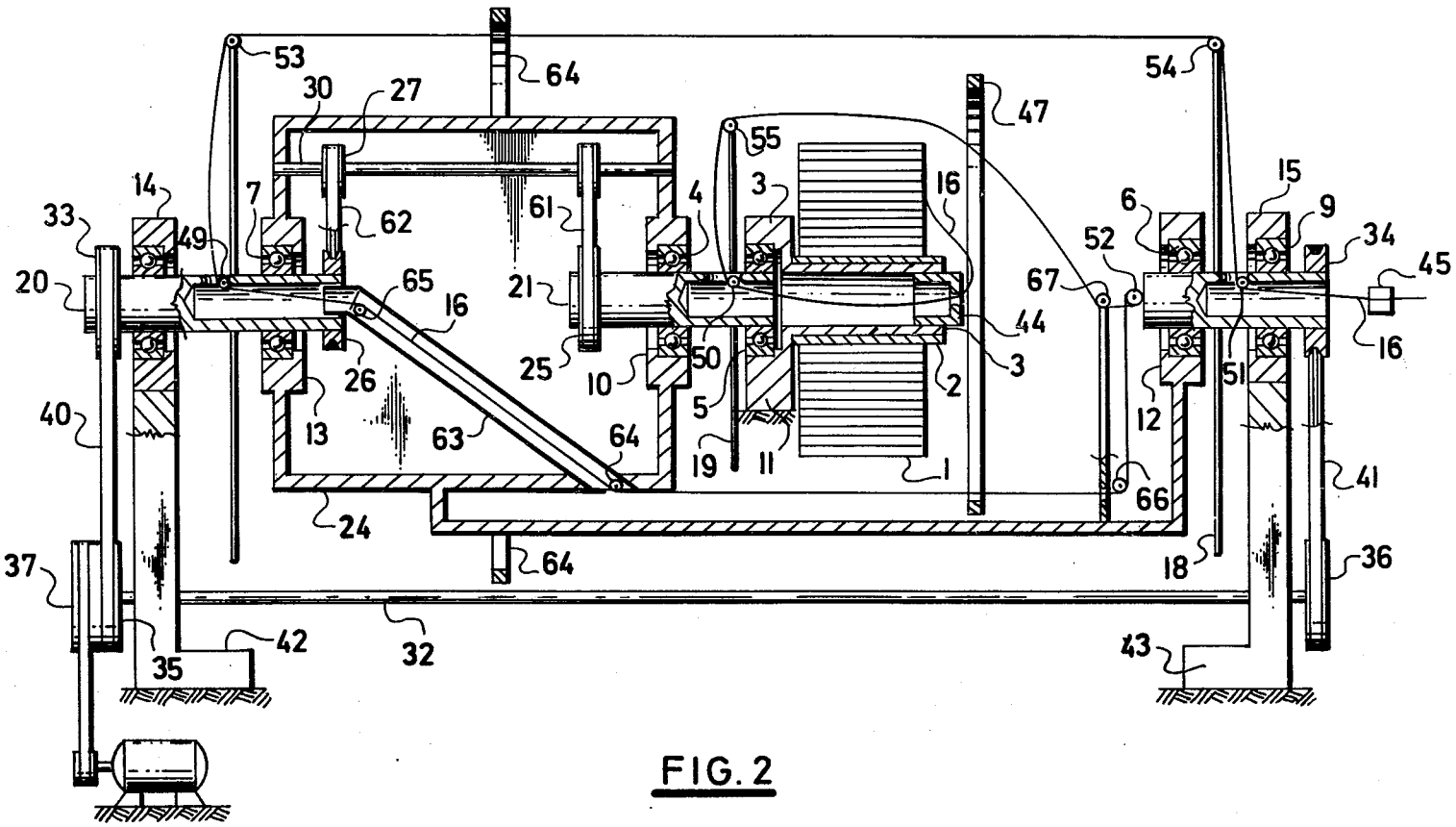
FIG. 2 shows an arrangement, where all shafts rotate in the same sense of rotation.

The arrangement according to FIG. 2 operates similarly to that shown in FIG. 1, the main difference being that all shafts 20,21,22 are rotating in the same sense. Similar elements bear the same reference numbers as in FIG. 1. The trough 46 has here a somewhat different shape, with an inclined stationary tube 63 fixed to the gear case 24 and engaging with its other end freely into the hollow part of shaft 20. Guiding rolls 64 and 65 are near both extremities of this tube 63. The transmissions in this gear case 24 are accomplished by pulleys 26,27,28,25 and belts 61,62, the pulleys 27 and 28 being fixed on a shaft 30, pulley 26 on shaft 20, pulley 25 on shaft 21. Balloon control rings 47 are rectifying the course of the processed fibrous material 16.

The processed fibrous material 16 is taken off from the supply package 1, passes through the filament brake 44, through the hollow support 3 of the supply package 1, over roll 50 to roll 55 on the carrier 19 fixed on shaft 21, to the eyelet 67, galette 52, roll 66 opening in wall 69, roll 64 in tube 63, roll 65/hollow of shaft 20, roll 49, roll 53 on the carrier fixed to shaft 20, roll 54 on carrier fixed to shaft 22, roll 51, hollow of shaft 22 to the take-up device 45. The operation of this arrangement is substantially the same as that shown in FIG. 1.

I claim:

1. An arrangement for twisting of fibrous material while moving said material along a predetermined path, comprising in combination:

a frame, at least three partly hollow shafts rotatably supported within said frame, said shafts being situated one behind the other, a carrier for the processed fibrous material mounted on each of said shafts, means for rotating said shafts, a stationary hollow support for holding a supply package of the fibrous material to be processed, said support being situated between the middle shaft and one of the outer shafts, a filament brake at one end of said hollow support, a take-up device for the processed fibrous material behind the second outer shaft, guiding elements for the fibrous material disposed along the path of the processed fibrous material, for guiding said fibrous material from the supply package over said filament brake through the hollow support, into the hollow of the middle shaft, to the carrier fixed on said shaft, to the hollow of one of the outer shafts, to the carrier fixed on said shaft, to the carrier fixed on the other outer shaft, to the hollow of said other outer shaft and to the take-up device.

2. The arrangement as claimed in claim 1, including means for rotating all three shafts in the same sense.

3. The arrangement as claimed in claim 1, including means for rotating one of the three shafts in a sense opposite to that of both remaining shafts.

4. The arrangement as claimed in claim 1, including means for rotating all shafts at the same rotational speed.

5. The arrangement as claimed in claim 1, including means for rotating at least one of the shafts at a speed different from that of the remaining shafts.

6. The arrangement as claimed in claim 1, wherein all three shafts are coaxial.

* * * * *

UNITED STATES PATENT AND TRADEMARK OFFICE

CERTIFICATE OF CORRECTION

PATENT NO. : 4,165,599
DATED : August 28, 1979
INVENTOR(S) : Ferdinand Lenorak

It is certified that error appears in the above—identified patent and that said Letters Patent is hereby corrected as shown below:

Column 1, line 24: Cancel "only".

line 55: "examplary" should be --exemplary--.

Column 2, line 14: "over" should be --outer--.

Signed and Sealed this

*Twenty-fifth* Day of *March 1980*

[SEAL]

*Attest:*

SIDNEY A. DIAMOND

*Attesting Officer* *Commissioner of Patents and Trademarks*